US011756491B2

(12) United States Patent
Zhang et al.

(10) Patent No.: US 11,756,491 B2
(45) Date of Patent: Sep. 12, 2023

(54) DISPLAY DEVICE DRIVING METHOD FOR IMPROVING CONTRAST OF LIQUID CRYSTAL DISPLAY PANEL

(71) Applicant: TCL CHINA STAR OPTOELECTRONICS TECHNOLOGY CO., LTD., Shenzhen (CN)

(72) Inventors: Xin Zhang, Shenzhen (CN); Tao He, Shenzhen (CN)

( * ) Notice: Subject to any disclaimer, the term of this patent is extended or adjusted under 35 U.S.C. 154(b) by 466 days.

(21) Appl. No.: 16/982,598

(22) PCT Filed: May 18, 2020

(86) PCT No.: PCT/CN2020/090782
§ 371 (c)(1),
(2) Date: Sep. 21, 2020

(87) PCT Pub. No.: WO2021/217744
PCT Pub. Date: Nov. 4, 2021

(65) Prior Publication Data

US 2023/0106250 A1 Apr. 6, 2023

(30) Foreign Application Priority Data

Apr. 28, 2020 (CN) ..... 202010348523.0

(51) Int. Cl.
*G09G 3/34* (2006.01)
*G09G 3/36* (2006.01)

(52) U.S. Cl.
CPC ..... *G09G 3/342* (2013.01); *G09G 3/3696* (2013.01); *G09G 2320/0646* (2013.01); *G09G 2320/0673* (2013.01)

(58) Field of Classification Search
CPC ..... G09G 3/342; G09G 3/36; G09G 3/3611; G09G 3/3614; G09G 3/3622; G09G 3/3625; G09G 3/364; G09G 3/3644; G09G 3/3648; G09G 3/3677; G09G 3/3681; G09G 3/3685; G09G 3/3688; G09G 3/3692;
(Continued)

(56) References Cited

U.S. PATENT DOCUMENTS

2005/0001801 A1* 1/2005 Kim ..... G09G 3/3406 345/89
2009/0167658 A1* 7/2009 Yamane ..... G09G 3/3406 345/89
(Continued)

FOREIGN PATENT DOCUMENTS

CN 105575341 A 5/2016
CN 106297731 A 1/2017
(Continued)

*Primary Examiner* — Amit Chatly
*Assistant Examiner* — Nelson Lam

(57) ABSTRACT

The present invention provides a display device driving method, a display device. The method achieves dynamic adjustment of a brightness of light emission of backlight units according to display contents corresponding to the display units. Also, conversion of a bit width of a drive voltage value is implemented based on a drive voltage conversion relationship table between first bit width drive voltage values and second bit width drive voltage values of the brightness values, which improves the driving effect of the backlight module.

16 Claims, 7 Drawing Sheets

(58) Field of Classification Search
CPC ..... G09G 3/3696; G09G 2320/0646; G09G 2320/0673
USPC ..... 345/87–104
See application file for complete search history.

(56) References Cited

U.S. PATENT DOCUMENTS

| | | | | |
|---|---|---|---|---|
| 2010/0013871 | A1* | 1/2010 | Shen | G09G 3/3406 345/691 |
| 2012/0019167 | A1* | 1/2012 | Chen | G09G 3/3406 315/307 |
| 2012/0181947 | A1* | 7/2012 | An | G09G 3/342 315/287 |
| 2014/0204131 | A1* | 7/2014 | Chen | G09G 3/36 345/691 |
| 2015/0123888 | A1* | 5/2015 | Uemura | G09G 3/3406 315/149 |
| 2016/0111047 | A1* | 4/2016 | Yamato | G09G 3/3611 345/102 |

FOREIGN PATENT DOCUMENTS

| | | | |
|---|---|---|---|
| CN | 106328088 | A | 1/2017 |
| JP | 2018054679 | A | 4/2018 |

* cited by examiner

| | | | | | | | | | |
|---|---|---|---|---|---|---|---|---|---|
| R-1-i-Z | R-1-i-Y | R-2-i-Z | R-2-i-Y | R-3-i-Z | R-3-i-Y | …… | …… | B-5-i-Z | B-5-i-Y |

$$f\left(L_{block_n}\right) = \begin{cases} 1 & (L_{block_n} \leq th1\ , block_n = 0{\sim}N) \\ 0{\sim}1 & (th1 < L_{block_n} < th2, block_n = 0{\sim}N\ ) \\ 0 & (L_{block_n} \geq th2\ , block_n = 0{\sim}N) \end{cases}$$

$$\begin{cases} BL_{val} = (L_{ave} + 0.5 * f(x)) * (1 - ra) + L_{ave} * ra \\ ra = f(L_{block_n}) \\ f(x) = L_{dif} + \frac{L_{dif}^2}{255} \\ L_{dif} = L_{max} - L_{ave} \end{cases}$$

DISPLAY DEVICE DRIVING METHOD FOR IMPROVING CONTRAST OF LIQUID CRYSTAL DISPLAY PANEL

FIELD OF INVENTION

The present invention relates to a field of display technologies, especially relates to a display device driving method and a display device.

BACKGROUND OF INVENTION

With improvement of resolutions of display devices, users' requirement to contrast of display devices becomes higher. Because of a phenomenon of light leakage of a dark status existing in liquid crystal display panels, it is resulted in a generally low contrast in display devices equipped with liquid crystal display panels.

SUMMARY OF INVENTION

Technical Issue

The present invention provides a display device driving method, display device for improving contrast of a display device of a liquid crystal display panel.

Technical Solution

To solve the above issue, technical solutions of the present invention are as follows:

An embodiment of the present invention provides a display device driving method, wherein the display device comprises a backlight module, a liquid crystal display panel, and a main control chip, the backlight module comprises a first driver chip, the liquid crystal display panel comprises a second driver chip; a backlight source of the backlight module comprises a plurality of backlight units arranged in an array and driver circuits corresponding to the backlight units, the liquid crystal display panel comprises a plurality of display units arranged in an array, each of the display units comprises a plurality of pixels, the backlight units correspond to the display units, and the display device driving method comprises:

by the main control chip, obtaining a brightness datum of each of the pixels of target display units when a target display frame is displayed, determining target brightness values of target backlight units corresponding to the target display units when the target display frame is displayed according to the brightness datum of each of the pixels in the target display units, determining first bit width drive voltage values of the target backlight units when the target display frame is displayed according to the target brightness values of the target backlight units corresponding to the target display units when the target display frame is displayed, determining second bit width drive voltage values of the target backlight units when the target display frame is displayed according to a drive voltage conversion relationship table between the first bit width drive voltage values and the second bit width drive voltage values based on the brightness values, and transmitting the second bit width drive voltage values to the first driver chip;

by the main control chip, determining a drive voltage value of each of the pixels in the target display units when the target display frame is displayed according to the brightness datum of each of the pixels in the target display units when the target display frame is displayed, and transmitting the drive voltage value to the second driver chip;

by the first driver chip, driving each of the backlight units of the backlight module to emit light according to the second bit width drive voltage values of the target backlight units when the target display frame is displayed; and by the second driver chip, driving the pixels of each of the display units in the liquid crystal display panel to transmit light according to the drive voltage value of each of the pixels in the target display units when the target display frame is displayed.

In the display device driving method provided by the embodiment of the present invention, the step of determining the second bit width drive voltage values of the target backlight units when the target display frame is displayed according to the drive voltage conversion relationship table between the first bit width drive voltage values and the second bit width drive voltage values based on the brightness values, comprises:

calling the drive voltage conversion relationship table; and converting the first bit width drive voltage values of target backlight units when the target display frame is displayed into the second bit width drive voltage values of the target backlight units when the target display frame is displayed according to a correspondence between the first bit width drive voltage values and the second bit width drive voltage values in the drive voltage conversion relationship table.

In the display device driving method provided by the embodiment of the present invention, before the step of calling the drive voltage conversion relationship table, the method further comprises:

obtaining a correspondence between light emission brightness values of the backlight units and the second bit width drive voltage values;

obtaining a gamma curve, wherein the gamma curve comprises a corresponding variation curve of the first bit width drive voltage values to the brightness values; and generating the drive voltage conversion relationship table based on the brightness values according to the gamma curve and the correspondence between the light emission brightness values and the second bit width drive voltage values of the backlight units.

In the display device driving method provided by the embodiment of the present invention, the step of generating the drive voltage conversion relationship table based on the brightness values according to the gamma curve and the correspondence between the light emission brightness values and the second bit width drive voltage values of the backlight units, comprises:

obtaining the brightness value of each of the first bit width drive voltage values according to the gamma curve;

in the correspondence between the light emission brightness values and the second bit width drive voltage values of the backlight units, determining the light emission brightness values matching the brightness values of the first bit width drive voltage values according to the brightness value of each of the first bit width drive voltage values; and determining the correspondence between the first bit width drive voltage values and the second bit width drive voltage values and obtaining the drive voltage conversion relationship table according to the light emission brightness values matching the brightness values of the first bit width drive voltage values.

In the display device driving method provided by the embodiment of the present invention, before the step of obtaining the brightness datum of each of the pixels in the target display units when the target display frame is displayed, the method further comprises:

by the main control chip, obtaining a bit width value of a drive voltage value of the liquid crystal display panel;

when the bit width value of the drive voltage value of the liquid crystal display panel is equal to a bit width value of each of the second bit width drive voltage values, determining the second bit width drive voltage values of the target backlight units when the target display frame is displayed according to the drive voltage conversion relationship table between the first bit width drive voltage values and the second bit width drive voltage values based on the brightness values; and when the bit width value of the drive voltage value of the liquid crystal display panel is equal to a bit width value of each of the first bit width drive voltage values, determining the second bit width drive voltage values of the target backlight units when the target display frame is displayed according to a bit width data conversion table.

In the display device driving method provided by the embodiment of the present invention, the step of by the main control chip, obtaining the brightness datum of each of the pixels in the target display units when the target display frame is displayed, according to the brightness datum of each of the pixels in the target display units and determining the target brightness values of the target backlight units corresponding to the target display units when the target display frame is displayed, comprises:

by the main control chip, obtaining the brightness datum of each of the pixels in the target display units when the target display frame is displayed;

determining noise data of an image to be displayed of the target display units when the target display frame is displayed according to the brightness datum of each of the pixels in the target display units; and determining the target brightness values of target backlight units corresponding to the target display units when the target display frame is displayed according to the brightness datum of each of the pixels in the target display units and the noise data of the image to be displayed of the target display units.

In the display device driving method provided by the embodiment of the present invention, the step of determining the noise data of the image to be displayed of the target display units when the target display frame is displayed according to the brightness datum of each of the pixels in the target display units, comprises:

traversing each of the pixels in the target display units sequentially according to a traverse parameter and obtaining a plurality of traverse blocks;

determining a brightness sum value of all of the pixels in each of the traverse blocks according to the brightness datum of each of the pixels in the target display units; and determining the noise data of the image to be displayed of the target display units when the target display frame is displayed according to a method of determining the noise data corresponding to the target display units and the brightness sum value of all of the pixels in each of the traverse blocks.

In the display device driving method provided by the embodiment of the present invention, the step of determining the noise data of the image to be displayed of the target display units when the target display frame is displayed according to a method of determining the noise data corresponding to the target display units and the brightness sum value of all of the pixels in each of the traverse blocks, comprises:

setting the noise data of the image to be displayed of the target display units as a first numerical value when each of the brightness sum values of all of the pixels of all of the traverse blocks is less than a first threshold value;

setting the noise data of the image to be displayed of the target display units as a second numerical value when the brightness sum value of all of the pixels of any one of the traverse blocks is greater than a second threshold value; and setting the noise data of the image to be displayed of the target display units as a third numerical value when each of the brightness sum values of all of the pixels of all of the traverse blocks is less than the second threshold value and the brightness sum value of all of the pixels of any one of the traverse blocks is greater than the first threshold value.

In the display device driving method provided by the embodiment of the present invention, the step of setting the noise data of the image to be displayed of the target display units as a third numerical value, comprises:

selecting the traverse blocks each of which has the brightness sum value of all of the pixels less than the second threshold value and greater than the first threshold value out from all of the traverse blocks as subject traverse blocks; and determining the third numerical value according to a total amount of the subject traverse blocks.

In the display device driving method provided by the embodiment of the present invention, the step of by the main control chip, determining a drive voltage value of each of the pixels in the target display units when the target display frame is displayed according to the brightness datum of each of the pixels in the target display units when the target display frame is displayed, and transmitting the drive voltage value to the second driver chip, comprises:

reading compression demura data in a compressed status stored in the storage device, and loading the compression demura data into a memory, wherein the compression demura data comprise compressed demura data corresponding to the display units and identifiers configured to identify addresses of the compressed demura data respectively;

calling at least two decoding modules; based on the identifiers, by the at least two decoding modules, decoding one of the compression demura data in the memory corresponding to a current display position, and obtaining a decoded actual demura datum of each of the display units of the current display position; and determining the drive voltage value of each of the pixels in the target display units when the target display frame is displayed based on the brightness datum of each of the pixels and the actual demura datum, and transmitting the drive voltage value to the second driver chip.

The embodiment of the present invention also provides a display device, comprising a backlight module, a liquid crystal display panel, and a main control chip, wherein the backlight module comprises a first driver chip, the liquid crystal display panel comprises a second driver chip; a backlight source of the backlight module comprises a plurality of backlight units arranged in an array and driver circuits corresponding to the backlight units, the liquid crystal display panel comprises a plurality of display units arranged in an array, each of the display units comprises a plurality of pixels, and the backlight units correspond to the display units, wherein:

the main control chip is configured to obtain a brightness datum of each of the pixels of target display units when a target display frame is displayed, according to the brightness datum of each of the pixels in the target display units, determine target brightness values of target backlight units corresponding to the target display units when the target display frame is displayed, determine first bit width drive voltage values of the target backlight units when the target display frame is displayed according to the target brightness values of the target backlight units corresponding to the target display units when the target display frame is displayed, determine the second bit width drive voltage values of the target backlight units when the target display frame is displayed according to a drive voltage conversion relationship table between the first bit width drive voltage values and the second bit width drive voltage values based on the brightness values, and transmit the second bit width drive voltage values to the first driver chip;

the main control chip is configured to determine a drive voltage value of each of the pixels in the target display units when the target display frame is displayed according to the brightness datum of each of the pixels in the target display units when the target display frame is displayed, and transmit the drive voltage value to the second driver chip;

the first driver chip is configured to drive each of the backlight units of the backlight module to emit light according to the second bit width drive voltage values of the target backlight units when the target display frame is displayed; and the second driver chip is configured to drive the pixels of each of the display units in the liquid crystal display panel to transmit light according to the drive voltage value of each of the pixels in the target display units when the target display frame is displayed.

In the display device provided by the embodiment of the present invention, the main control chip is configured to: call the drive voltage conversion relationship table; and convert the first bit width drive voltage values of target backlight units when the target display frame is displayed into the second bit width drive voltage values of the target backlight units when the target display frame is displayed according to a correspondence between the first bit width drive voltage values and the second bit width drive voltage values in the drive voltage conversion relationship table.

In the display device provided by the embodiment of the present invention, the main control chip is configured to: obtain a correspondence between light emission brightness values of the backlight units and the second bit width drive voltage values; obtain a gamma curve, wherein the gamma curve comprises a corresponding variation curve of the first bit width drive voltage values to the brightness values; and generate the drive voltage conversion relationship table based on the brightness values according to the gamma curve and the correspondence between the light emission brightness values and the second bit width drive voltage values of the backlight units.

In the display device provided by the embodiment of the present invention, the main control chip is configured to: obtain the brightness value of each of the first bit width drive voltage values according to the gamma curve; in the correspondence between the light emission brightness values and the second bit width drive voltage values of the backlight units, determine the light emission brightness values matching the brightness values of the first bit width drive voltage values according to the brightness value of each of the first bit width drive voltage values; and determine a correspondence between the first bit width drive voltage values and the second bit width drive voltage values and obtain the drive voltage conversion relationship table according to the light emission brightness values matching the brightness values of the first bit width drive voltage values.

In the display device provided by the embodiment of the present invention, the main control chip is configured to: obtain a bit width value of a drive voltage value of the liquid crystal display panel; when the bit width value of the drive voltage value of the liquid crystal display panel is equal to a bit width value of each of the second bit width drive voltage values, determine the second bit width drive voltage values of the target backlight units when the target display frame is displayed according to the drive voltage conversion relationship table between the first bit width drive voltage values and the second bit width drive voltage values based on the brightness values; and when the bit width value of the drive voltage value of the liquid crystal display panel is equal to a bit width value of each of the first bit width drive voltage values, determine the second bit width drive voltage values of the target backlight units when the target display frame is displayed according to a bit width data conversion table.

In the display device provided by the embodiment of the present invention, the main control chip is configured to:

obtain the brightness datum of each of the pixels in the target display units when the target display frame is displayed;

determine noise data of an image to be displayed of the target display units when the target display frame is displayed according to the brightness datum of each of the pixels in the target display units; and determine the target brightness values of target backlight units corresponding to the target display units when the target display frame is displayed according to the brightness datum of each of the pixels in the target display units and the noise data of the image to be displayed of the target display units.

In the display device provided by the embodiment of the present invention, the main control chip is configured to:

traverse the pixels in the target display units sequentially according to a traverse parameter and obtain a plurality of traverse blocks;

determine a brightness sum value of all of the pixels in each of the traverse blocks according to the brightness datum of each of the pixels in the target display units; and determine the noise data of the image to be displayed of the target display units when the target display frame is displayed according to a method of determining the noise data corresponding to the target display units and the brightness sum value of all of the pixels in each of the traverse blocks.

In the display device provided by the embodiment of the present invention, the main control chip is configured to:

set the noise data of the image to be displayed of the target display units as a first numerical value when each of the brightness sum values of all of the pixels of all of the traverse blocks is less than a first threshold value;

set the noise data of the image to be displayed of the target display units as a second numerical value when the brightness sum value of all of the pixels of any one of the traverse blocks is greater than a second threshold value; and set the noise data of the image to be displayed of the target display units as a third numerical value when each of the brightness sum values of all of the pixels of all of the traverse blocks is less than the second threshold value and the brightness sum value of all of the pixels of any one of the traverse blocks is greater than the first threshold value.

In the display device provided by the embodiment of the present invention, the main control chip is configured to:

select the traverse blocks each of which has the brightness sum value of all of the pixels less than the second threshold value and greater than the first threshold value out from all of the traverse blocks as subject traverse blocks; and determine the third numerical value according to a total amount of the subject traverse blocks.

In the display device provided by the embodiment of the present invention, the main control chip is configured to:

read compression demura data in a compressed status stored in a storage device, and load the compression demura data into a memory, wherein the compression demura data comprise compressed demura data corresponding to the display units and identifiers configured to identify addresses of the compressed demura data respectively;

call at least two decoding modules; based on the identifiers, by the at least two decoding modules, decode one of the compression demura data in the memory corresponding to a current display position, and obtain a decoded actual demura datum of each of the display units of the current display position; and determine the drive voltage value of each of the pixels in the target display units when the target display frame is displayed based on the brightness datum of each of the pixels and the actual demura datum, and transmit the drive voltage value to the second driver chip.

Advantages

The present invention provides a display device driving method and a display device, the method divides a backlight source into a plurality of backlight units that are driven individually, and then obtains a brightness datum of each of the pixels, according to the brightness datum of each of the pixels in the target display units when a target display frame is displayed target display units, determines target brightness values of target backlight units corresponding to the target display units when the target display frame is displayed, and further determines first bit width drive voltage values of the target backlight units when the target display frame is displayed, and finally determines the second bit width drive voltage values of the target backlight units when the target display frame is displayed according to a drive voltage conversion relationship table between the first bit width drive voltage values and the second bit width drive voltage values based on the brightness values. In other words, the method, based on display contents required to be displayed on the display unit corresponding to each of the backlight units, determines a drive voltage value of each of the backlight units, which achieves dynamic adjustment of the light emission brightness of the backlight units according to the display contents of corresponding ones of the display units. Especially, in the dark status of the display panel the backlight can be switched off at any time, which can increase the contrast of the entire display device when images are displayed. In the meantime, during conversion of the bit width of the drive voltage value, the conversion is implemented based on a drive voltage conversion relationship table between the first bit width drive voltage values and the second bit width drive voltage values, which achieve a better driving effect of the backlight module.

DESCRIPTION OF DRAWINGS

To more clearly elaborate on the technical solutions of embodiments of the present invention or prior art, appended figures necessary for describing the embodiments of the present invention or prior art will be briefly introduced as follows. Apparently, the following appended figures are merely some embodiments of the present invention. A person of ordinary skill in the art may acquire other figures according to the appended figures without any creative effort.

DETAILED DESCRIPTION OF PREFERRED EMBODIMENTS

Figure 1:
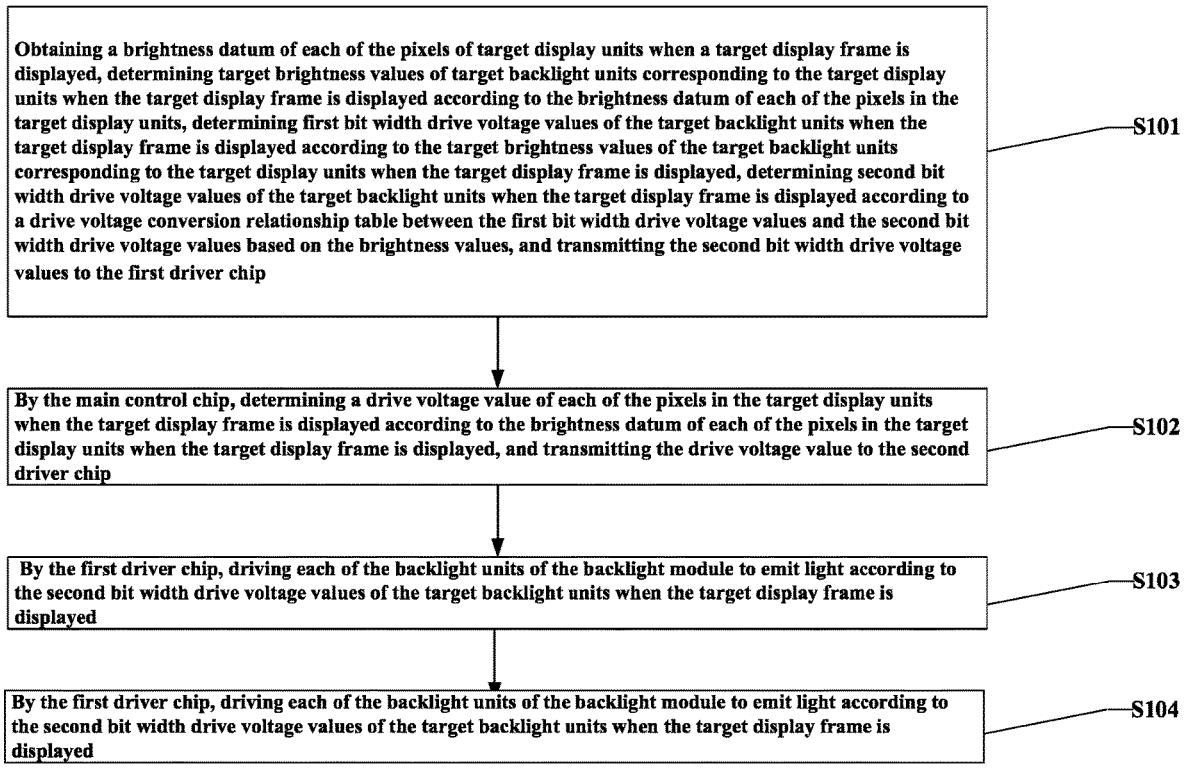
FIG. 1 is a flowchart of a display device driving method provided by an embodiment of the present invention.

Each of the following embodiments is described with appending figures to illustrate specific embodiments of the present invention that are applicable. The terminologies of direction mentioned in the present invention, such as "upper", "lower", "front", "rear", "left", "right", "inner", "outer", "side surface", etc., only refer to the directions of the appended figures. Therefore, the terminologies of direction are used for explanation and comprehension of the present invention, instead of limiting the present invention. In the figures, units with similar structures are marked with the same reference characters.

In the present invention, a target display frame is a display frame required to be displayed by the display device but not displayed yet. Generally, a display frame is determined according to texts and videos to be displayed, and the present invention is intended to describe it repeatedly. Preferably, the target display frame is a next display frame for a current display frame, which is able to lower a storage cost for data. As follows, without specifically limitations, parameters such as brightness data, noise data, target brightness values of target backlight units, drive voltage values of target backlight units (including first bit width drive voltage values and second bit width drive voltage values), and a drive voltage value each of the pixels, relating to the present invention, are parameters of the target display frame or parameter required by the display device when displaying target display frame.

In the present invention, a brightness datum refers to brightness values of all of sub-pixels of each of the pixels in a corresponding display frame, a noise datum refers to a correction coefficient corresponding to a noise in the corresponding display frame. A noise refers to a rough portion during a process in which an apparatus such as a digital camera receives light as a receiving signal and outputs an image. Namely, external pixels that should've not appear in the image are generated by electronic interference. A size of a noise is smaller and has a lower brightness in comparison to pixels such that an effect of the noise in a display image with a greater brightness to a backlight brightness can be ignored. However, the effect of the noise becomes greater to an image in a lower brightness, especially in a dark status, and the present invention consider such factor.

In the present invention, a drive voltage value determined by a main control chip of the display device according to a brightness is usually 8 bit bit width (i.e., first bit width), and a light source of the backlight module for example a bit width of the drive voltage value actually used by LED, can be 12 bit, and it is required to implement conversion of the bit width.

With reference to FIG. 1, a display device driving method provided by the embodiment of the present invention: steps S101 to S104.

The step S101 comprises by the main control chip, obtaining a brightness datum of each of the pixels of target display units when a target display frame is displayed, determining target brightness values of target backlight units corresponding to the target display units when the target display frame is displayed according to the brightness datum of each of the pixels in the target display units, determining first bit width drive voltage values of the target backlight units when the target display frame is displayed according to the target brightness values of the target backlight units corresponding to the target display units when the target display frame is displayed, determining second bit width drive voltage values of the target backlight units when the target display frame is displayed according to a drive voltage conversion relationship table between the first bit width drive voltage values and the second bit width drive voltage values based on the brightness values, and transmitting the second bit width drive voltage values to the first driver chip.

In an embodiment, the present step comprises: by the main control chip, obtaining the brightness datum of each of the pixels in the target display units when the target display frame is displayed, determining noise data of an image to be displayed of the target display units when the target display frame is displayed according to the brightness datum of each of the pixels in the target display units, and determining the target brightness values of target backlight units corresponding to the target display units when the target display frame is displayed according to the brightness datum of each of the pixels in the target display units and the noise data of the image to be displayed of the target display units.

In an embodiment, the step of determining the noise data of the image to be displayed of the target display units when the target display frame is displayed according to the brightness datum of each of the pixels in the target display units, comprises: traversing each of the pixels in the target display units sequentially according to a traverse parameter and obtaining a plurality of traverse blocks; determining a brightness sum value of all of the pixels in each of the traverse blocks according to the brightness datum of each of the pixels in the target display units; and determining the noise data of the image to be displayed of the target display units when the target display frame is displayed according to a method of determining the noise data corresponding to the target display units and the brightness sum value of all of the pixels in each of the traverse blocks. The traverse parameter can be determined according to noises presented in images of different resolutions.

In an embodiment, the present step, before the step of determining the noise data of the image to be displayed of the target display units when the target display frame is displayed according to a method of determining the noise data corresponding to the target display units and the brightness sum value of all of the pixels in each of the traverse blocks, further comprises: determining a brightness average value of each of the pixels in the target display units according to the brightness datum of each of the pixels in the target display units; determining a threshold value parameter corresponding to the target display units according to the brightness average value of each of the pixels in the target display units; and obtaining the method of determining the noise data corresponding to the target display units according to a predetermined noise datum determining method and the threshold value parameter corresponding to the target display units.

In an embodiment, the step of determining the noise data of the image to be displayed of the target display units when the target display frame is displayed according to a method of determining the noise data corresponding to the target display units and the brightness sum value of all of the pixels in each of the traverse blocks, comprises: setting the noise data of the image to be displayed of the target display units as a first numerical value when each of the brightness sum values of all of the pixels of all of the traverse blocks is less than a first threshold value; setting the noise data of the image to be displayed of the target display units as a second numerical value when the brightness sum value of all of the pixels of any one of the traverse blocks is greater than a second threshold value; and setting the noise data of the image to be displayed of the target display units as a third numerical value when each of the brightness sum values of all of the pixels of all of the traverse blocks is less than the second threshold value and the brightness sum value of all of the pixels of any one of the traverse blocks is greater than the first threshold value.

In an embodiment, the step of setting the noise data of the image to be displayed of the target display units as the third numerical value, comprises: selecting the traverse blocks each of which has the brightness sum value of all of the pixels less than the second threshold value and greater than the first threshold value out from all of the traverse blocks as subject traverse blocks; and determining the third numerical value according to a total amount of the subject traverse blocks.

In an embodiment, the step of setting the noise data of the image to be displayed of the target display units as the third numerical value, comprises: selecting a maximum one of the brightness sum values of all of the pixels of the traverse blocks as the subject traverse block; and determining the third numerical value according to the brightness sum value of the subject traverse block.

In an embodiment, the step of determining the target brightness values of target backlight units corresponding to the target display units when the target display frame is displayed according to the brightness datum of each of the pixels in the target display units and the noise data of the image to be displayed of the target display units, comprises: determining the brightness average value and a maximum brightness value of each of the pixels in the target display units according to the brightness datum of each of the pixels in the target display units; and determining the target brightness values of target backlight units corresponding to the target display units when the target display frame is displayed according to the brightness average value, the maximum brightness value, and the noise datum.

In an embodiment, the step of determining the target brightness values of target backlight units corresponding to the target display units when the target display frame is displayed according to the brightness average value, the maximum brightness value, and the noise datum, comprises: determining a compensation brightness value according to the brightness average value and the maximum brightness value; and determining the target brightness values of target backlight units corresponding to the target display units when the target display frame is displayed according to the brightness average value, the compensation brightness values, and the noise datum.

In an embodiment, the step of determining the compensation brightness values according to the brightness average value and the maximum brightness value, comprises: determining a brightness difference value according to the brightness average value and the maximum brightness value; and determining the compensation brightness value according to the brightness difference value and a predetermined compensating method.

The specific implementation scenario of the present step will be described below.

In an embodiment, the present step comprises: determining first bit width drive voltage values of the target backlight units when the target display frame is displayed according to the target brightness values of the target backlight units corresponding to the target display units when the target display frame is displayed, determining second bit width drive voltage values of the target backlight units when the target display frame is displayed according to a drive voltage conversion relationship table between the first bit width drive voltage values and the second bit width drive voltage values based on the brightness values, and transmitting the second bit width drive voltage values to the first driver chip.

In an embodiment, the step of determining the second bit width drive voltage values of the target backlight units when the target display frame is displayed according to a drive voltage conversion relationship table between the first bit width drive voltage values and the second bit width drive voltage values based on the brightness values, comprising: calling the drive voltage conversion relationship table; and converting the first bit width drive voltage values of target backlight units when the target display frame is displayed into the second bit width drive voltage values of the target backlight units when the target display frame is displayed according to a correspondence between the first bit width drive voltage values and the second bit width drive voltage values in the drive voltage conversion relationship table.

In an embodiment, before the step of calling the drive voltage conversion relationship table, the method further comprises: obtaining a correspondence between light emission brightness values of the backlight units and the second bit width drive voltage values; obtaining a gamma curve, wherein the gamma curve comprises a corresponding variation curve of the first bit width drive voltage values to the brightness values; and generating the drive voltage conversion relationship table based on the brightness values according to the gamma curve and the correspondence between the light emission brightness values and the second bit width drive voltage values of the backlight units.

In an embodiment, the step of generating the drive voltage conversion relationship table based on the brightness values according to the gamma curve and the correspondence between the light emission brightness values and the second bit width drive voltage values of the backlight units, comprises: obtaining the brightness value of each of the first bit width drive voltage values according to the gamma curve; in the correspondence between the light emission brightness values and the second bit width drive voltage values of the backlight units, determining the light emission brightness values matching the brightness values of the first bit width drive voltage values according to the brightness value of each of the first bit width drive voltage values; and determining the correspondence between the first bit width drive voltage values and the second bit width drive voltage values and obtaining the drive voltage conversion relationship table according to the light emission brightness values matching the brightness values of the first bit width drive voltage values.

In an embodiment, before the step of obtaining the brightness datum of each of the pixels in the target display units when the target display frame is displayed, the method further comprises: by the main control chip, obtaining a bit width value of a drive voltage value of the liquid crystal display panel; when the bit width value of the drive voltage value of the liquid crystal display panel is equal to a bit width value of each of the second bit width drive voltage values, determining the second bit width drive voltage values of the target backlight units when the target display frame is displayed according to the drive voltage conversion relationship table between the first bit width drive voltage values and the second bit width drive voltage values based on the brightness values; and when the bit width value of the drive voltage value of the liquid crystal display panel is equal to a bit width value of each of the first bit width drive voltage values, determining the second bit width drive voltage values of the target backlight units when the target display frame is displayed according to a bit width data conversion table.

The step S102 comprises by the main control chip, determining a drive voltage value of each of the pixels in the target display units when the target display frame is displayed according to the brightness datum of each of the pixels in the target display units when the target display frame is displayed, and transmitting the drive voltage value to the second driver chip.

In an embodiment, the present step comprises: reading compression demura data in a compressed status stored in the storage device, and loading the compression demura data into a memory, wherein the compression demura data comprise compressed demura data corresponding to the display units and identifiers configured to identify addresses of the compressed demura data respectively; calling at least two decoding modules; based on the identifiers, by the at least two decoding modules, decoding one of the compression demura data in the memory corresponding to a current display position, and obtaining a decoded actual demura datum of each of the display units of the current display position; and using the actual demura datum of each of the display units to drive the display panel to operate, which in other words means determining the drive voltage value of each of the pixels in the target display units when the target display frame is displayed based on the brightness datum of each of the pixels and the actual demura datum, and transmitting the drive voltage value to the second driver chip.

The step S103 comprises by the first driver chip, driving each of the backlight units of the backlight module to emit light according to the second bit width drive voltage values of the target backlight units when the target display frame is displayed.

The step S104 comprises by the first driver chip, driving each of the backlight units of the backlight module to emit light according to the second bit width drive voltage values of the target backlight units when the target display frame is displayed.

Figure 3:
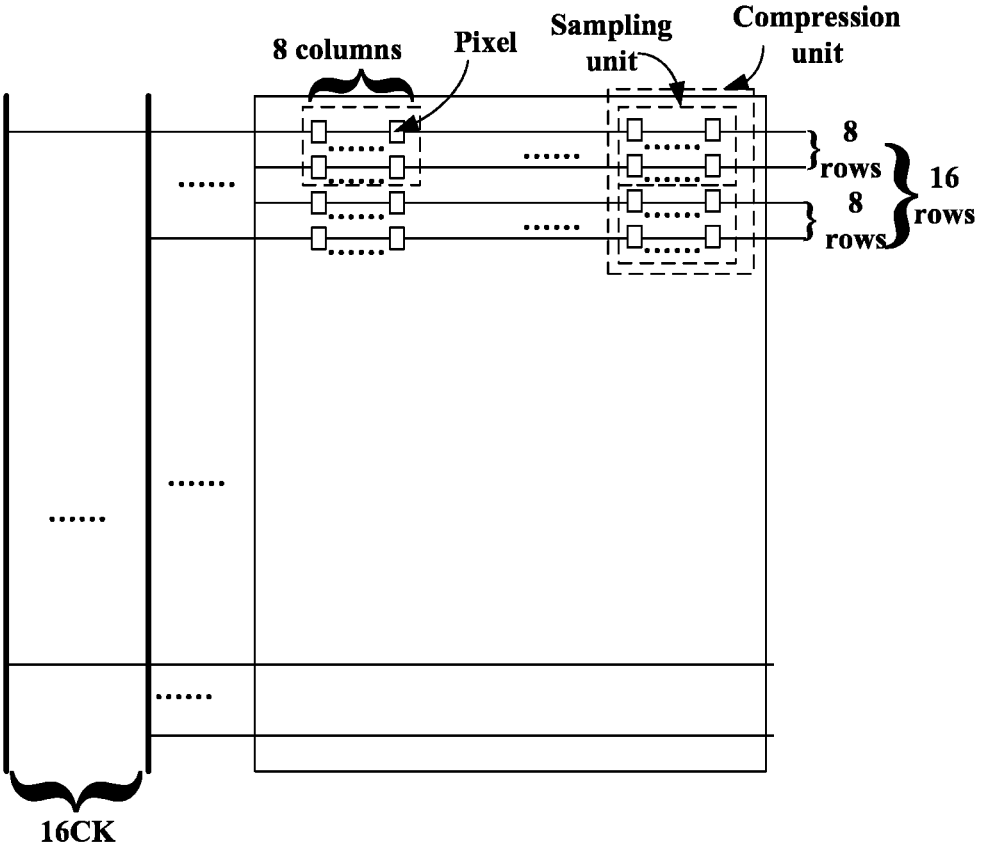
FIG. 3 is a schematic view of connection of the display panel of the embodiment of the present invention.

In an embodiment, the display panel comprises display units arranged in an array, and each of the display units comprises at least one pixel unit. A conventional demura technique processes each of the pixels of a display panel in real time. Namely, each of the pixels corresponds to a demura value. With increase of a resolution of the display panel, such method results in a greater occupation TO storage space. Thus, with reference to FIG. 3, the present invention employs a downsampling technology, two concepts of sampling units and compression units. A size of a sampling unit (a number of pixels included) can be set according to demand. The present invention aims at a 8K (resolution is 7680*4320) high definition display panel, and sets a size of a sampling unit as 8*8 (8 columns multiply 8 rows). Each of the sampling units includes 64 pixels, such 64 pixels uses a same demura value, which reduces a quantity of demura data corresponding to the display panel to 1/64. In driving direction and driving sequence of the pixels, each of the compression units comprises a plurality of sampling units, with reference to FIG. 3, a 8K display panel provided by the embodiment of the present invention uses a gate driver on array (GOA) driver circuit of 16 CK (clock signal line). When images are displayed, in each display frame, according to a sequence from top to boeeom, 16 rows of pixels are scanned in each scanning, each of the compression units has a size of 32*2 (32 columns multiply 2 rows), totally 64 sampling units. Each display position (i.e., 16 rows of pixels) includes 30 (i.e., 7680÷32÷8) compression units, and compression demura datum corresponding to each display position comprise compression demura data corresponding to 30 compression units. Compression demura data corresponding to each of the compression units comprise compression demura data corresponding to 64 sampling units. For comprehension, the present invention sets the display units to be equal to compression units in quantity, namely the display units corresponds to the compression units.

In an embodiment, the present invention The pixels can refer to pixels employing a true RGB structure, in other words, in a same row of the pixels, red sub-pixels, green sub-pixels, and blue sub-pixels are arranged sequentially and circularly such that for sampling units, corresponding demura values are required and provided to sub-pixels of such three colors. Of course, in other predictable embodiments based on the present invention, pixels can be arranged with RGBW (red sub-pixels, green sub-pixels, blue sub-pixels, and white sub-pixels) 4 sub-pixels, and can be achieved by a sub-pixel multiplexing method. In some other predictable embodiments, a same demura value can be applied to sub-pixels of three different colors, or a same demura value is applied to sub-pixels of different colors.

Figure 4A:
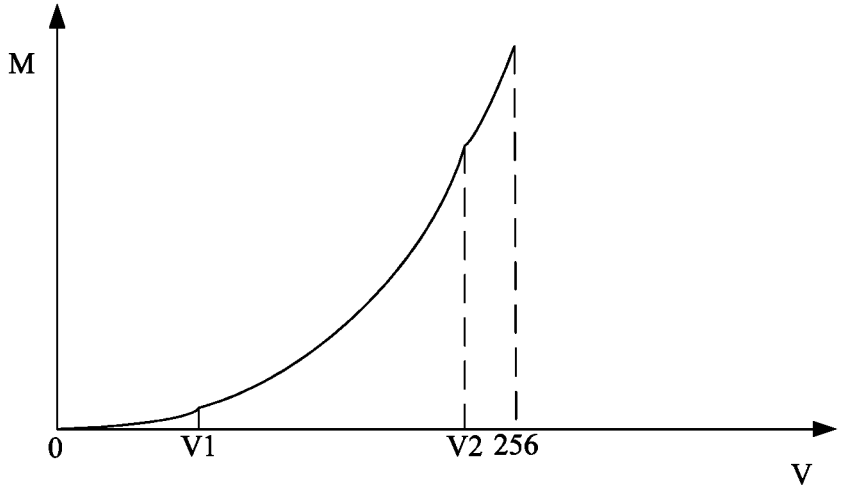
FIGS. 4*a* to 4*d* are schematic views of decoding configuration provided by the embodiment of the present invention.

In an embodiment, with reference to FIG. 4*a*, a relationship between a drive voltage V (i.e., grayscale voltage) of each of the pixels and a light emission brightness M approximates to an exponent function, which is called a gamma curve. Even though an error occurs in a process, the relationship between the drive voltage V (grayscale voltage) of each of the sub-pixels and the light emission brightness M still approximates to an exponent function, and a difference only exists in value of the exponent. When an exponent function is used for calculating demura values corresponding to different drive voltages, the datum become more complicated. Therefore, the present invention creatively employs function conversion to convert the exponent function into a combination of a linear function and a quadratic function, for convenience of calculation of demura values corresponding to different drive voltages V.

Still taking the 8K display panel as an example, a drive voltage thereof is a grayscale of 0-1023, which is totally 1024 levels, in a low grayscale region (0—V1) and a high grayscale region (V2—1023), a gamma curve approximates to a straight line. In a middle grayscale region (V1-V2), a gamma curve approximates to a parabola. Grayscale voltages V1 and V2 can be determined according to the actual situation of each of the pixels in each of the sampling units. Therefore, the present invention samples and obtains demura values corresponding to 5 drive voltages according to each light emission color of each of the sampling units. For an example of red sub-pixels, with reference to FIG. 4*b*, 5 theoretical drive voltages x1, x2, x3, x4, x5 are determined, wherein x2=V1, x4=V2, x1<x2<x3<x4<x5. A brightness L1 corresponding to the theoretical drive voltage x1 is determined based on the gamma curve, the display panel is driven to emit light, an actual drive voltage T1 is recorded when a light emission brightness of the sub-pixels reaches L1 (an average brightness of the sampling units), a correspondence between the theoretical drive voltage x1 and the actual drive voltage T1 of the red sub-pixels is obtained, and a correspondence between the theoretical drive voltages x2, x3, x4, x5 and the actual drive voltages T2, T3, T4, T5 of the red sub-pixels, a correspondence between theoretical drive voltages x1, x2, x3, x4, x5 and actual drive voltages T6, T7, T8, T9, T10 of the green sub-pixels, and a correspondence between theoretical drive voltages x1, x2, x3, x4, x5 and actual drive voltages T11, T12, T13, T14, T15 of the blue sub-pixels are obtained sequentially. Thus, each of the sampling units corresponds to 15 demura data. Because each of the compression units comprises 64 sampling units, then a number of the demura data blocks of each of the compression units is also 15. Each demura data block comprises demura data corresponding of 64 sampling units. For example, identifiers of 15 demura data blocks of compression units i (i refers to identifiers of the compression units according to compression units in the display panel each of which each identifier can only correspond to) are R-1-*i*, R-2-*i*, R-3-*i*, R-4-*i*, R-5-*i*, G-1-*i*, G-2-*i*, G-3-*i*, G-4-*i*, G-5-*i*, B-1-*i*, B-2-*i*, B-3-*i*, B-4-*i*, B-5-*i*. The demura data blocks R-1-*i* includes a correspondence of the theoretical drive voltage x1 (minimum brightness) and the actual drive voltage T1 of the red sub-pixels of 64 sampling units of the compression units i. The demura data blocks R-2-I include a correspondence of the theoretical drive voltage x2 (second minimum brightness) and the actual drive voltage T2 of the red sub-pixels of 64 sampling units of the compression units i.

Figures 4B, 4C:
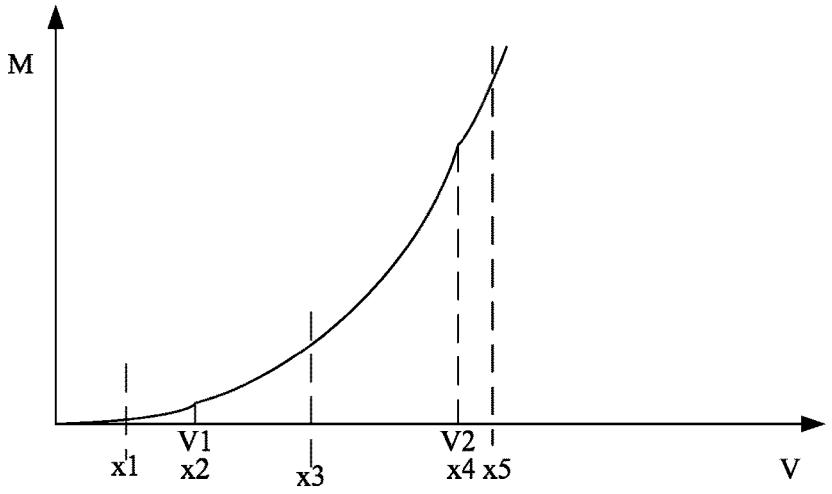

To reduce the datum, 15 demura data blocks R-1-*i*, R-2-*i*, R-3-*i*, R-4-*i*, R-5-*i*, G-1-*i*, G-2-*i*, G-3-*i*, G-4-*i*, G-5-*i*, B-1-*i*, B-2-*i*, B-3-*i*, B-4-*i*, B-5-*l* of the compression units i are compressed sequentially. Because an actual datum of each demura data block R (G/B) −1 (2/3/4/5) −I is different and is variable, after corresponding compression, each compression datum of the demura data block has a different size. Thus, theoretically, only after a compression datum of a current demura data block is decoded completely, can a start position of a compression datum of a next demura data block be acquired. Namely, compression data of the demura data blocks can only be decoded in series, and the manner requires a longer decoding time. For such issue, the embodiment of the present invention provides a solution of parallel decoding the compression datum of the demura data block. Correspondingly, the present invention improves the storage method for the compression demura data, the compression demura data includes compressed demura data of each of the display units, and identifiers each of which configured to identify a position of each of the compressed demura data. With reference to FIG. 4*c*, for easy distinguishing, compression data obtained by compressing the demura data blocks R (G/B) −1 (2/3/4/5) −i are marked as R (G/B) −1 (2/3/4/5) −i−Y, identifiers configured to identify positions of demura data blocks R (G/B) −1 (2/3/4/5) −i−Y are marked as R (G/B) −1 (2/3/4/5) −i−Z, wherein R can be replaced with G or B, and 1 can be replaced with one of 2 to 5. In FIG. 4*c*, the compressed demura data and the identifiers appear alternately. In another embodiment of the present invention, compression demura data comprises a head file, the head file comprises the identifier R (G/B) −1 (2/3/4/5) −i−Z configured to identify the position of each compression datum R (G/B) −1 (2/3/4/5) −i−Y of all compression units i of the display panel. Namely, all the identifiers are stored, and then the stored data are compressed, or the like.

In an embodiment, compressed demura data types comprise a light emission color (one of R, G, B) and an output light intensity (one of 1 to 5). Lengths of identifiers can be the same, for example, the length can be a constant length of 20 bytes, in which 16 bytes are for recording a position and later 4 bytes are for recording a type.

In an embodiment, the present step can call the decoding modules of a corresponding number according to a total amount of types of the demura data, and in the meantime, each of the decoding modules is configured to decode demura data of one type. Alternatively, decoding modules of a corresponding number are called according to a total amount of compression units of each display position, and in the meantime, each of the decoding modules is configured to decode demura data of one compression unit. Calling decoding modules of a corresponding number according to a total amount of types of the demura data are taken as an example and described as follows, and other solutions types will not be described repeatedly.

In an embodiment, for the 8K product, 15 decoding modules are called for implementing the present invention, for example, a decoding module 3-01 to a decoding module 3-15 are called for implementing the present invention, decoding modules 3-*i* are embodied through hardware.

Figure 4D:
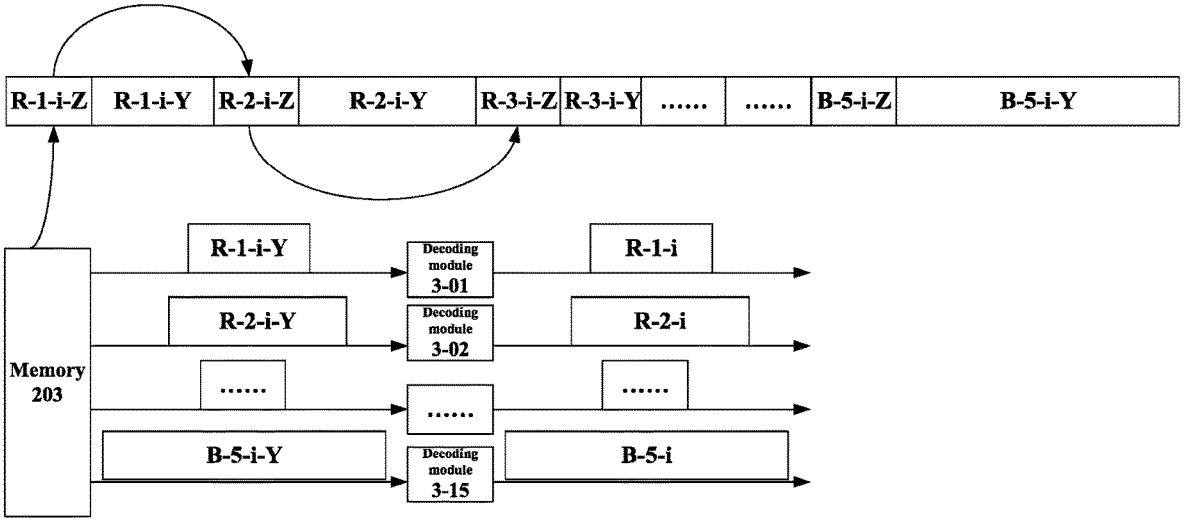

In an embodiment, the step of based on the identifiers, by the at least two decoding modules, decoding one of the compression demura data in the memory corresponding to a current display position, and obtaining a decoded actual demura datum of each of the display units of the current display position, comprises: establishing a mapping relation between the decoding modules and the demura datum types; reading a compression demura datum corresponding to a current display position of the memory; by the decoding modules, parallel decoding the compressed demura datum corresponding to the demura datum type of each of the decoding modules in the memory based on the identifiers and the mapping relation. With reference to FIG. 4*d*, a demura datum type corresponding to the decoding modules 3-01 is R-1, and a demura datum type corresponding to the decoding module 3-15 is B-5.

In an embodiment, the step of by the decoding modules, parallel decoding the compressed demura datum corresponding to the demura datum type of each of the decoding modules in the memory based on the identifiers and the mapping relation, comprises: determining a position and a type of the compressed demura datum of each of the display units in the compression demura data based on the identifiers; and by the decoding modules, parallel decoding the compressed demura datum of a corresponding type according to the position and the type of the compressed demura datum of each of the display units in the compression demura data. For example, a content of 20 bytes of the identifier is analyzed to obtain a position and a type of the compressed demura datum, and analysis is implemented accordingly.

In an embodiment, the step of by the decoding modules, parallel decoding the compressed demura datum of a corresponding type according to the position and the type of the compressed demura datum of each of the display units in the compression demura data, comprises: data-catching the compression demura data to obtain compressed demura data according to a position of the compressed demura datum of each of the display units in the compression demura data; according to the type of compressed demura datum of each of the display units in the compression demura data, allocating the compressed demura data to corresponding ones of the decoding modules; by the decoding modules, decoding the allocated compressed demura data. For example, the memory data-catches the compression demura data according to a position of the compressed demura datum of each of the display units in the compression demura data and obtains the compressed demura data, and then transmits the data to the decoding modules for decoding. In the present embodiment, data-catching is implemented by the memory.

In an embodiment, the step of by the decoding modules, parallel decoding the compressed demura datum of a corresponding type according to the position and the type of the compressed demura datum of each of the display units in the compression demura data, comprises: allocating a position of the compressed demura datum of each of the display units in the compression demura data to a corresponding one of the decoding modules; by the decoding modules, data-catching the compression demura data according to the position of compressed demura datum of each of the display units in the compression demura data and obtaining and decoding the compressed demura datum. For example, the memory allocates the position of the compressed demura datum of each of the display units in the compression demura data to a corresponding one of the decoding modules, and uses the decoding modules to data-catch the compression demura data according to the position of the compressed demura datum of each of the display units in the compression demura data and to obtain and decode the compressed demura data. In the present embodiment, data-catching is performed by the decoding modules.

In an embodiment, the step of determining a position and a type of the compressed demura datum of each of the display units in the compression demura data based on the identifiers, comprises: analyzing an identifier storage field of the compression demura datum and obtaining an identifier corresponding to the compressed demura datum; determining a position and a type of the compressed demura datum of each of the display units in the compression demura data according to a content of the identifier decompressed. for example, a header field is disposed in the compression demura datum as an identifier storage field, after the header field is decompressed, all of the identifiers can be obtained. According to a content of each of the identifiers, positions and types of all of the compressed demura data can be determined.

In an embodiment, the step of determining a position and a type of the compressed demura datum of each of the display units in the compression demura data based on the identifiers, comprises: analyzing a current identifier to obtain a content of the current identifier; determining a position of a next identifier and a type of a compressed demura datum corresponding to the next identifier according to the content of the current identifier; determining a position of a compressed demura datum corresponding to the next identifier according to the position of the next identifier and a content length of the next identifier. For example, a length of each of the identifiers is 20 bytes, and thus the position of the next identifier plus 20 bytes is the position of the compressed demura datum corresponding to the next identifier.

In an embodiment, the step of determining a position and a type of the compressed demura datum of each of the display units in the compression demura data based on the identifiers, comprises: analyzing a current identifier to obtain a content of the current identifier; determining a position of a next identifier according to the content of the current identifier; determining a position of the compressed demura datum corresponding to the next identifier according to a position of the next identifier and a content length of the next identifier, according to the content of the next identifier and a storage sequence of the compressed demura data each of the display units of different types in the compression demura data, determining a type of the compressed demura datum corresponding to the next identifier. For example, a length of each of the identifiers is 20 bytes, and thus the position of the next identifier plus 20 bytes is a position of the compressed demura datum corresponding to the next identifier. For example, the content of the next identifier comprises a compression sequence number. Because the storage sequence of the demura data is R-1-*i*, R-2-*i*, R-3-*i*, R-4-*i*, R-5-*i*, G-1-*i*, G-2-*i*, G-3-*i*, G-4-*i*, G-5-*i*, B-1-*i*, B-2-*i*, B-3-*i*, B-4-*i*, B-5-*l* that are compressed sequentially, a type can be determined according to the compression sequence number and the storage sequence.

In an embodiment, with reference to FIG. 4*d*, 15 decoding modules are used to decode data of 15 types simultaneously. However, because of variable length coding, a length of each data block is non-constant, and it is required to add an identifier in a front end of each data block. When decoding is performed, an identifier jump module first reads a position of an identifier R-2-*i*-Z from an identifier R-1-*i*-Z. When a first decoding module 3-01 starts to decode R-1-*i*-Y, the memory can extract R-2-*i*-Y out from a rear of the identifier R-2-*i*-Z and transmit R-2-*i*-Y to a second decoding module 3-02, and simultaneously obtain a position of the identifier R-3-*i*-Z, and so on. By jump under indication of 15 identifiers, 15 decoding modules can work simultaneously.

Advantages of the embodiment of the present invention are analyzed as follows: For a 8K display panel with a refresh rate of 60 Hz, a clock frequency of 594 MHz are applied usually in the among industries. A display image of each 16 rows, under fastest situation, only has 30720 clock cycles. In other words, an average time of decompression of each data block R (G/B) −1 (2/3/4/5) −i −Y is only 68 (30720÷30÷15) clock cycles. Because compression employs variable length coding, a start position of a next datum would only be identified after a former datum has been completely processed, and each data block has at most 64 data (data of each of the sampling units). Namely, in the worst situation, fetching a datum spends a time of 64 clocks, and the time further taking necessary conversion operation after datum fetching into account to inevitably exceeds the limitation of 68 clock cycles, which cannot achieve a real-time processing function. The present invention jumps under indication of 15 identifiers, and can make the 15 decoding modules to work simultaneously. Limitation to a number of clock cycles corresponding to each data block has been loosened from 68 to 1024 (30720÷30), which can make demura compression data of the 8K display panel be decompressed in real-time to lower the hardware cost and production time.

In an embodiment, after the actual demura datum of each of the display units is acquired, for a certain light emission color of a certain one of the sampling units, an average drive voltage (theoretical value) xp of all sub-pixels of the light emission color of the sampling units in a next display frame can be calculated, and then a grayscale region corresponding to the average drive voltage (theoretical value) xp is determined, and a corresponding correspondence is called to calculate and obtain an actual drive voltage Tx corresponding to the average drive voltage (theoretical value) xp to further a demura datum (xp−Tx) corresponding to the light emission color sub-pixels in the sampling units. Accordingly, a sum of theoretical drive voltage (theoretical value) x and demura datum (xp−Tx) of each of the sub-pixels can determine an actual drive voltage V (V=x+xp−Tx of each of the sub-pixels to further complete the demura function.

Figure 2:
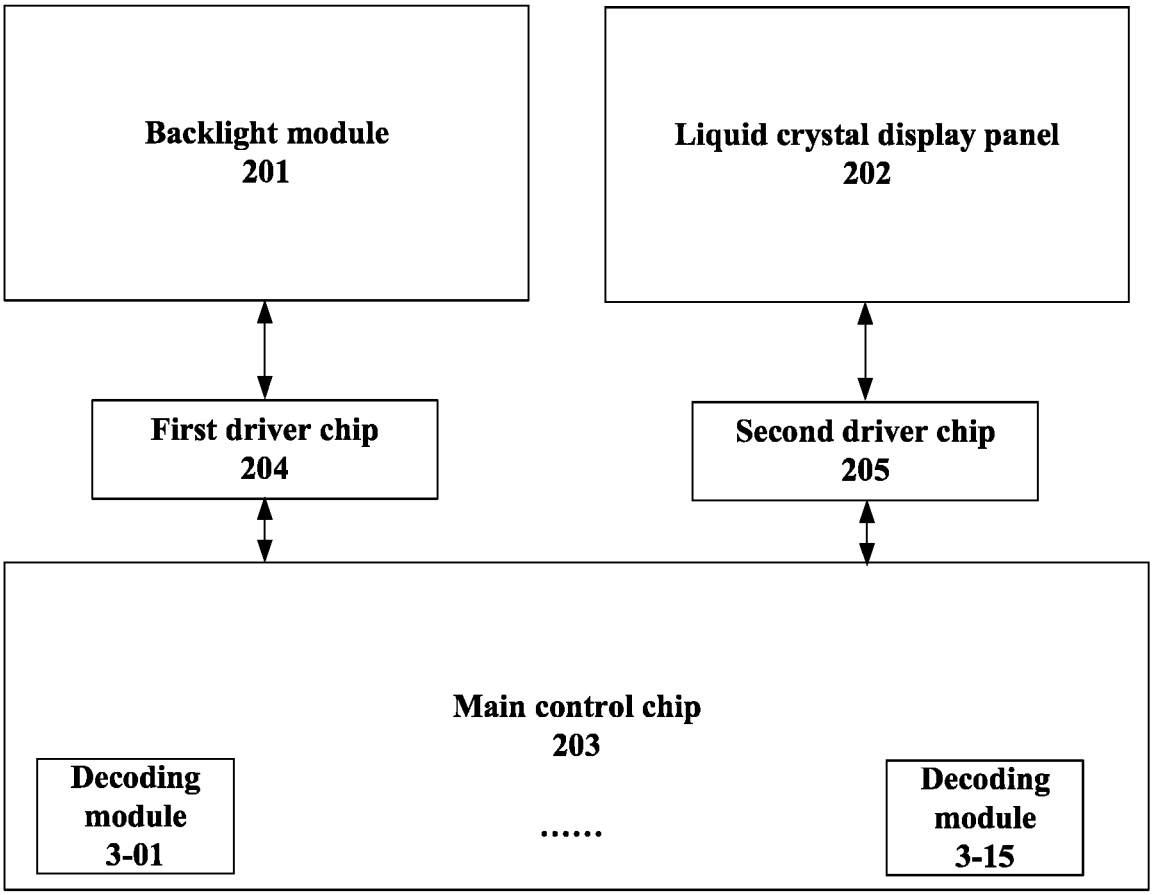
FIG. 2 is a schematic view of a module of a display device provided by the embodiment of the present invention.

In an embodiment, with reference to FIG. 2, the display device provided by the embodiment of the present invention comprises: a backlight module 201, a liquid crystal display panel 202, and a main control chip 203. The backlight module comprises a first driver chip 204. The liquid crystal display panel comprises a second driver chip 205. A backlight source of the backlight module comprises a plurality of backlight units arranged in an array and a driver circuits corresponding to each of the backlight units. The liquid crystal display panel comprises a plurality of display units arranged in an array. The display units comprise a plurality of pixels. The backlight units correspond to the display units, wherein:

the main control chip is configured to obtain a brightness datum of each of the pixels of target display units when a target display frame is displayed, according to the brightness datum of each of the pixels in the target display units, determine target brightness values of target backlight units corresponding to the target display units when the target display frame is displayed, determine first bit width drive voltage values of the target backlight units when the target display frame is displayed according to the target brightness values of the target backlight units corresponding to the target display units when the target display frame is displayed, determine the second bit width drive voltage values of the target backlight units when the target display frame is displayed according to a drive voltage conversion relationship table between the first bit width drive voltage values and the second bit width drive voltage values based on the brightness values, and transmit the second bit width drive voltage values to the first driver chip;

the main control chip is configured to determine a drive voltage value of each of the pixels in the target display units when the target display frame is displayed according to the brightness datum of each of the pixels in the target display units when the target display frame is displayed, and transmit the drive voltage value to the second driver chip;

the first driver chip is configured to drive each of the backlight units of the backlight module to emit light according to the second bit width drive voltage values of the target backlight units when the target display frame is displayed; and the second driver chip is configured to drive the pixels of each of the display units in the liquid crystal display panel to transmit light according to the drive voltage value of each of the pixels in the target display units when the target display frame is displayed.

In an embodiment, the main control chip is configured to: call the drive voltage conversion relationship table; and convert the first bit width drive voltage values of target backlight units when the target display frame is displayed into the second bit width drive voltage values of the target backlight units when the target display frame is displayed according to a correspondence between the first bit width drive voltage values and the second bit width drive voltage values in the drive voltage conversion relationship table.

In an embodiment, the main control chip is configured to: obtain a correspondence between light emission brightness values of the backlight units and the second bit width drive voltage values; obtain a gamma curve, wherein the gamma curve comprises a corresponding variation curve of the first bit width drive voltage values to the brightness values; and generate the drive voltage conversion relationship table based on the brightness values according to the gamma curve and the correspondence between the light emission brightness values and the second bit width drive voltage values of the backlight units.

In an embodiment, the main control chip is configured to: obtain the brightness value of each of the first bit width drive voltage values according to the gamma curve; in the correspondence between the light emission brightness values and the second bit width drive voltage values of the backlight units, determine the light emission brightness values matching the brightness values of the first bit width drive voltage values according to the brightness value of each of the first bit width drive voltage values; and determine a correspondence between the first bit width drive voltage values and the second bit width drive voltage values and obtain the drive voltage conversion relationship table according to the light emission brightness values matching the brightness values of the first bit width drive voltage values.

In an embodiment, the main control chip is configured to: obtain a bit width value of a drive voltage value of the liquid crystal display panel; when the bit width value of the drive voltage value of the liquid crystal display panel is equal to a bit width value of each of the second bit width drive voltage values, determine the second bit width drive voltage values of the target backlight units when the target display frame is displayed according to the drive voltage conversion relationship table between the first bit width drive voltage values and the second bit width drive voltage values based on the brightness values; and when the bit width value of the drive voltage value of the liquid crystal display panel is equal to a bit width value of each of the first bit width drive voltage values, determine the second bit width drive voltage values of the target backlight units when the target display frame is displayed according to a bit width data conversion table.

In an embodiment, the main control chip is configured to:

obtain the brightness datum of each of the pixels in the target display units when the target display frame is displayed;

determine noise data of an image to be displayed of the target display units when the target display frame is displayed according to the brightness datum of each of the pixels in the target display units; and determine the target brightness values of the target backlight units corresponding to the target display units when the target display frame is displayed according to the brightness datum of each of the pixels in the target display units and the noise data of the image to be displayed of the target display units.

In an embodiment, the main control chip is configured to:

traverse the pixels in the target display units sequentially according to a traverse parameter and obtain a plurality of traverse blocks;

determine a brightness sum value of all of the pixels in each of the traverse blocks according to the brightness datum of each of the pixels in the target display units; and determine the noise data of the image to be displayed of the target display units when the target display frame is displayed according to a method of determining the noise data corresponding to the target display units and the brightness sum value of all of the pixels in each of the traverse blocks.

In an embodiment, the main control chip is configured to:

set the noise data of the image to be displayed of the target display units as a first numerical value when each of the brightness sum values of all of the pixels of all of the traverse blocks is less than a first threshold value;

set the noise data of the image to be displayed of the target display units as a second numerical value when the brightness sum value of all of the pixels of any one of the traverse blocks is greater than a second threshold value; and set the noise data of the image to be displayed of the target display units as a third numerical value when each of the brightness sum values of all of the pixels of all of the traverse blocks is less than the second threshold value and the brightness sum value of all of the pixels of any one of the traverse blocks is greater than the first threshold value.

In an embodiment, the main control chip is configured to:

select the traverse blocks each of which has the brightness sum value of all of the pixels less than the second threshold value and greater than the first threshold value out from all of the traverse blocks as subject traverse blocks; and determine the third numerical value according to a total amount of the subject traverse blocks.

In the display device provided by the embodiment of the present invention, the main control chip is configured to:

read compression demura data in a compressed status stored in a storage device, and load the compression demura data into a memory, wherein the compression demura data comprise compressed demura data corresponding to the display units and identifiers configured to identify addresses of the compressed demura data respectively;

call at least two decoding modules; based on the identifiers, by the at least two decoding modules, decode one of the compression demura data in the memory corresponding to a current display position, and obtain a decoded actual demura datum of each of the display units of the current display position; and determine the drive voltage value of each of the pixels in the target display units when the target display frame is displayed based on the brightness datum of each of the pixels and the actual demura datum, and transmit the drive voltage value to the second driver chip.

Taking a display device of a 8K resolution as an example, the present invention is described as follows.

In an embodiment, a backlight of a backlight module is spliced by 12 backplates. Each backplate includes 432 subregions, each subregion has 4 LED lamps connected in series. The 4 LED lamps is driven by a driver circuit to form a backlight unit. For example, 12 lamp strips are disposed and spliced in parallel, each lamp strip includes 8*54 backlight units, and 4 LED lamps correspond to one of the display units of the liquid crystal display panel. Each of the display units of the liquid crystal display panel includes 80*80 pixels, a size of each of the traverse blocks is 5*5 pixels.

Figures 5A, 5B:
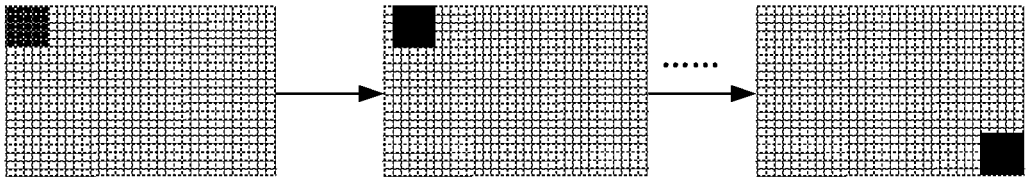
FIGS. 5*a* to 5*d* are schematic views of calculation configuration provided by the embodiment of the present invention.
Figures 5C, 5D:
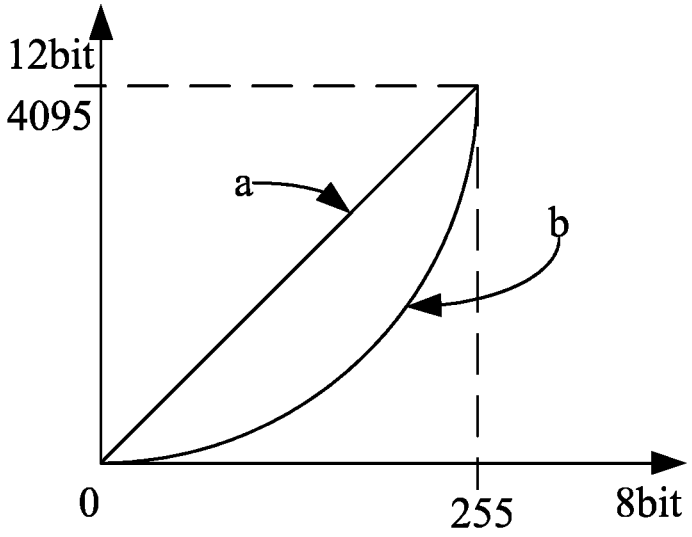

Accordingly, with regard to how to calculate brightness values of the backlight units, a traversing method as shown in FIG. 5*a* is employed, transverses a display image (80*80 pixels) of the display units corresponding to each of backlight units to obtain 79*79 (N in FIG. 5*b*) traverse blocks block, adds up brightness values of all of the pixels in each of the traverse blocks block to obtain a brightness sum value $L_{block}$ corresponding to each of the traverse blocks block, and determines a noise datum ra corresponding to the backlight units based on the noise datum determining method as shown in FIG. 5*b*, and further determines target brightness values of the backlight units according to the target brightness values determining method as shown in FIG. 5*c*.

Specifically, in the calculation method of FIGS. 5*b* to 5*c*:

$L_{ave}$ refers to an average brightness value of the target backlight units corresponding to all of the pixels of the target display units, $L_{max}$ refers to a maximum brightness value of the target backlight units corresponding to all of the pixels of the target display units, $L_{dif}$ refers to a brightness difference value of the target backlight units corresponding to all of the pixels of the target display units, f(x) refers to a compensation brightness value corresponding to the target backlight units, and $BL_{val}$ refers to a target brightness value corresponding to the target backlight units.

In the determining method as shown in FIG. 5*b*, display devices with different specifications correspond to different threshold values th1 and th2. Furthermore, when each of the brightness sum values of all of the pixels of all of the traverse blocks is less than the first threshold value, the noise data of the image to be displayed of the target display units is set as a first numerical value, i.e., ra=1;

When the brightness sum value of all of the pixels of any one of the traverse blocks is greater than a second threshold value, the noise data of the image to be displayed of the target display units is set as a second numerical value, i.e., ra=0;

when each of the brightness sum values of all of the pixels of all of the traverse blocks is less than the second threshold value and the brightness sum value of all of the pixels of any one of the traverse blocks is greater than the first threshold value, setting the noise data of the image to be displayed of the target display units as the third numerical value, i.e., a numerical value with ra=0 to 1, for example, 0.5.

At this time, an image of a display unit corresponding to a backlight unit is in a dark status, and few noises exist, brightness sum values $L_{block}$ corresponding to all of the traverse blocks block are less than the threshold value th1, at this time, the noise datum is ra=1. Accordingly, with reference to FIG. 5*c*, a target brightness value of the backlight unit is the same as the average brightness value, i.e., i.e., $BL_{val}=L_{ave}$. Therefore, by the ra coefficient, input of the noises can be lowered, especially to the black image. However, in a scene with some inputted white noise, $L_{ave}$ value is extremely low and is approximately zero, and the backlight unit can be closed exactly.

With regard to how to implement conversion of drive voltage values of the backlight units, it is assumed that LED actual output brightness levels of the backlight units of the 8K resolution display panel includes 4096 levels, namely the second bit width is 12 bit bit width. At this time:

First, a brightness value of a LED of each level in drive voltages of levels 0-4095 is measured and caught, Lm[m=0-4095], and the datum is obtained by normalization: Lmv [m=0-4095].

According to an inputted image content, a brightness value is obtained by calculation of 8 bit (i.e., the first bit width is 8 bit), $BL_{val}$ is a digital signal only including 256 levels which are level 0-255.

With regard to the 8 bit datum, a gamma curve is simulated to normalize the datum, according to an equation as follows:

Lga(n)=(n/255)^ga, wherein, n=0-255, ga=2.2 (adjustable);

The brightness Lmv[m=0-4095] are traversed, to find each brightness of Lga(n) which is the most approximate brightness of the LED; a drive voltage conversion relationship table is obtained, and a correspondence between first bit width drive voltage values and second bit width drive voltage values in the table is as follows:

A brightness of Lga(0) is substantially equal to a brightness of LED Lmv[0], i.e., 0 map (corresponds to) 0;

A brightness of Lga(1) is substantially equal to a brightness of LED Lmv[3], i.e., 1 map 3;

A brightness of Lga(2) is substantially equal to a brightness of LED Lmv[7], i.e., 2 map 7;

A brightness of Lga(3) is substantially equal to a brightness of LED Lmv[14], i.e., 3 map 14;

A brightness of Lga(4) is substantially equal to a brightness of LED Lmv[22], i.e., 4 map 22;

. . . .

A brightness of Lga(255) is substantially equal to a brightness of LED Lmv[4095], i.e., 255 map 4095.

On the basis of the above a correspondence, a diagram of drive voltage a correspondence can be depicted as shown in FIG. 5*d*. with reference to FIG. 5*d*, when a method of directly converting a 8 bit bit width into a 12 bit bit width is applied, a correspondence curve a between drive voltages of two different bit widths is a straight line (1 corresponds to 16, 2 corresponds to 32). A correspondence curve b of drive voltages based on the brightness depicted according to the correspondence is a gamma curve, and is more consistent with a display effect of LEDs. Implementing a drive voltage value conversion based on such correspondence curve b can achieve a greater display effect.

In the above-mentioned embodiments, the descriptions of the various embodiments are focused. For the details of the embodiments not described, reference may be made to the related descriptions of the other embodiments.

The display device driving method and the display device provided by the embodiment of the present invention are introduced in details as above. The principles and implementations of the present application are described in the following by using specific examples. The description of the above embodiments is only for assisting understanding of the technical solutions of the present application and the core ideas thereof. Those of ordinary skill in the art should understand that they can still modify the technical solutions described in the foregoing embodiments are or equivalently replace some of the technical features. These modifications or replacements do not depart from the essence of the technical solutions of the embodiments of the present application.

What is claimed is:

1. A display device driving method, wherein a display device comprises a backlight module, a liquid crystal display panel, and a main control chip, the backlight module comprises a first driver chip, the liquid crystal display panel comprises a second driver chip; a backlight source of the backlight module comprises a plurality of backlight units arranged in an array and driver circuits corresponding to the backlight units, the liquid crystal display panel comprises a plurality of display units arranged in an array, each of the display units comprises a plurality of pixels, the backlight units correspond to the display units, and the display device driving method comprises:

by the main control chip, obtaining a brightness datum of each of the pixels of target display units when a target display frame is displayed, determining target brightness values of target backlight units corresponding to the target display units when the target display frame is displayed according to the brightness datum of each of the pixels in the target display units, determining first bit width drive voltage values of the target backlight units when the target display frame is displayed according to the target brightness values of the target backlight units corresponding to the target display units when the target display frame is displayed, determining second bit width drive voltage values of the target backlight units when the target display frame is displayed according to a drive voltage conversion relationship table between the first bit width drive voltage values and the second bit width drive voltage values based on the brightness values, and transmitting the second bit width drive voltage values to the first driver chip;

by the main control chip, determining a drive voltage value of each of the pixels in the target display units when the target display frame is displayed according to the brightness datum of each of the pixels in the target display units when the target display frame is displayed, and transmitting the drive voltage value to the second driver chip;

by the first driver chip, driving each of the backlight units of the backlight module to emit light according to the second bit width drive voltage values of the target backlight units when the target display frame is displayed; and by the second driver chip, driving the pixels of each of the display units in the liquid crystal display panel to transmit light according to the drive voltage value of each of the pixels in the target display units when the target display frame is displayed;

wherein a step of determining the second bit width drive voltage values of the target backlight units when the target display frame is displayed according to the drive voltage conversion relationship table between the first bit width drive voltage values and the second bit width drive voltage values based on the brightness values, comprises:

calling the drive voltage conversion relationship table; and converting the first bit width drive voltage values of target backlight units when the target display frame is displayed into the second bit width drive voltage values of the target backlight units when the target display frame is displayed according to a correspondence between the first bit width drive voltage values and the second bit width drive voltage values in the drive voltage conversion relationship table;

wherein before a step of calling the drive voltage conversion relationship table, the method further comprises:

obtaining a correspondence between light emission brightness values of the backlight units and the second bit width drive voltage values;

obtaining a gamma curve, wherein the gamma curve comprises a corresponding variation curve of the first bit width drive voltage values to the brightness values; and generating the drive voltage conversion relationship table based on the brightness values according to the gamma curve and the correspondence between the light emission brightness values and the second bit width drive voltage values of the backlight units.

2. The display device driving method as claimed in claim 1, wherein the step of generating the drive voltage conversion relationship table based on the brightness values according to the gamma curve and the correspondence between the light emission brightness values and the second bit width drive voltage values of the backlight units, comprises:

obtaining the brightness value of each of the first bit width drive voltage values according to the gamma curve;

in the correspondence between the light emission brightness values and the second bit width drive voltage values of the backlight units, determining the light emission brightness values matching the brightness values of the first bit width drive voltage values according to the brightness value of each of the first bit width drive voltage values; and determining the correspondence between the first bit width drive voltage values and the second bit width drive voltage values and obtaining the drive voltage conversion relationship table according to the light emission brightness values matching the brightness values of the first bit width drive voltage values.

3. The display device driving method as claimed in claim 1, wherein before a step of obtaining the brightness datum of each of the pixels in the target display units when the target display frame is displayed, the method further comprises:

by the main control chip, obtaining a bit width value of a drive voltage value of the liquid crystal display panel;

when the bit width value of the drive voltage value of the liquid crystal display panel is equal to a bit width value of each of the second bit width drive voltage values, determining the second bit width drive voltage values of the target backlight units when the target display frame is displayed according to the drive voltage conversion relationship table between the first bit width drive voltage values and the second bit width drive voltage values based on the brightness values; and when the bit width value of the drive voltage value of the liquid crystal display panel when the bit width value of the drive voltage value of the liquid crystal display panel is equal to a bit width value of each of the first bit width drive voltage values, determining the second bit width drive voltage values of the target backlight units when the target display frame is displayed according to a bit width data conversion table.

4. The display device driving method as claimed in claim 1, wherein a step of by the main control chip, obtaining the brightness datum of each of the pixels in the target display units when the target display frame is displayed, according to the brightness datum of each of the pixels in the target display units and determining the target brightness values of the target backlight units corresponding to the target display units when the target display frame is displayed, comprises:

by the main control chip, obtaining the brightness datum of each of the pixels in the by the main control chip, obtaining the brightness datum of each of the pixels in the target display units when the target display frame is displayed;

determining noise data of an image to be displayed of the target display units when the target display frame is displayed according to the brightness datum of each of the pixels in the target display units; and determining the target brightness values of the target backlight units corresponding to the target display units when the target display frame is displayed according to the brightness datum of each of the pixels in the target display units and the noise data of the image to be displayed of the target display units.

5. The display device driving method as claimed in claim 4, wherein the step of determining the noise data of the image to be displayed of the target display units when the target display frame is displayed according to the brightness datum of each of the pixels in the target display units, comprises:

traversing the pixels in the target display units sequentially according to a traverse parameter and obtaining a plurality of traverse blocks;

determining a brightness sum value of all of the pixels in each of the traverse blocks according to the brightness datum of each of the pixels in the target display units; and determining the noise data of the image to be displayed of the target display units when the target display frame is displayed according to a method of determining the noise data corresponding to the target display units and the brightness sum value of all of the pixels in each of the traverse blocks.

6. The display device driving method as claimed in claim 5, wherein the step of determining the noise data of the image to be displayed of the target display units when the target display frame is displayed according to a method of determining the noise data corresponding to the target display units and the brightness sum value of all of the pixels in each of the traverse blocks, comprises:

setting the noise data of the image to be displayed of the target display units as a first numerical value when each of the brightness sum values of all of the pixels of all of the traverse blocks is less than a first threshold value;

setting the noise data of the image to be displayed of the target display units as a setting the noise data of the image to be displayed of the target display units as a second numerical value when the brightness sum value of all of the pixels of any one of the traverse blocks is greater than a second threshold value; and setting the noise data of the image to be displayed of the target display units as a setting the noise data of the image to be displayed of the target display units as a third numerical value when each of the brightness sum values of all of the pixels of all of the traverse blocks is less than the second threshold value and the brightness sum value of all of the pixels of any one of the traverse blocks is greater than the first threshold value.

7. The display device driving method as claimed in claim 6, wherein the step of setting the noise data of the image to be displayed of the target display units as the third numerical value, comprises:

selecting the traverse blocks each of which has the brightness sum value of all of the pixels less than the second threshold value and greater than the first threshold value out from all of the traverse blocks as subject traverse blocks; and determining the third numerical value according to a total amount of the subject traverse blocks.

8. The display device driving method as claimed in claim 1, wherein a step of by the main control chip, determining a drive voltage value of each of the pixels in the target display units when the target display frame is displayed according to the brightness datum of each of the pixels in the target display units when the target display frame is displayed, and transmitting the drive voltage value to the second driver chip, comprises:

reading compression demura data in a compressed status stored in the storage device, and loading the compression demura data into a memory, wherein the compression demura data comprise compressed demura data corresponding to the display units and identifiers configured to identify addresses of the compressed demura data respectively;

calling at least two decoding modules; based on the identifiers, by the at least two decoding modules, decoding one of the compression demura data in the memory corresponding to a current display position, and obtaining a decoded actual demura datum of each of the display units of the current display position; and determining the drive voltage value of each of the pixels in the target display units when the target display frame is displayed based on the brightness datum of each of the pixels and the actual demura datum, and transmitting the drive voltage value to the second driver chip.

9. A display device, comprising a backlight module, a liquid crystal display panel, and a main control chip, wherein the backlight module comprises a first driver chip, the liquid crystal display panel comprises a second driver chip; a backlight source of the backlight module comprises a plurality of backlight units arranged in an array and driver circuits corresponding to the backlight units, the liquid crystal display panel comprises a plurality of display units arranged in an array, each of the display units comprises a plurality of pixels, and the backlight units correspond to the display units, wherein:

the main control chip is configured to obtain a brightness datum of each of the pixels of target display units when a target display frame is displayed, according to the brightness datum of each of the pixels in the target display units, determine target brightness values of target backlight units corresponding to the target display units when the target display frame is displayed, determine first bit width drive voltage values of the target backlight units when the target display frame is displayed according to the target brightness values of the target backlight units corresponding to the target display units when the target display frame is displayed, determine the second bit width drive voltage values of the target backlight units when the target display frame is displayed according to a drive voltage conversion relationship table between the first bit width drive voltage values and the second bit width drive voltage values based on the brightness values, and transmit the second bit width drive voltage values to the first driver chip;

the main control chip is configured to determine a drive voltage value of each of the pixels in the target display units when the target display frame is displayed according to the brightness datum of each of the pixels in the target display units when the target display frame is displayed, and transmit the drive voltage value to the second driver chip;

the first driver chip is configured to drive each of the backlight units of the backlight module to emit light according to the second bit width drive voltage values of the target backlight units when the target display frame is displayed; and the second driver chip is configured to drive the pixels of each of the display units in the liquid crystal display panel to transmit light according to the drive voltage value of each of the pixels in the target display units when the target display frame is displayed;

wherein the main control chip is configured to:

call the drive voltage conversion relationship table; and convert the first bit width drive voltage values of target backlight units when the target display frame is displayed into the second bit width drive voltage values of the target backlight units when the target display frame is displayed according to a correspondence between the first bit width drive voltage values and the second bit width drive voltage values in the drive voltage conversion relationship table;

wherein the main control chip is configured to:

obtain a correspondence between light emission brightness values of the backlight units and the second bit width drive voltage values; obtain a gamma curve, wherein the gamma curve comprises a corresponding variation curve of the first bit width drive voltage values to the brightness values; and generate the drive voltage conversion relationship table based on the brightness values according to the gamma curve and the correspondence between the light emission brightness values and the second bit width drive voltage values of the backlight units.

10. The display device as claimed in claim 9, wherein the main control chip is configured to: obtain the brightness value of each of the first bit width drive voltage values according to the gamma curve; in the correspondence between the light emission brightness values and the second bit width drive voltage values of the backlight units, determine the light emission brightness values matching the brightness values of the first bit width drive voltage values according to the brightness value of each of the first bit width drive voltage values; and determine a correspondence between the first bit width drive voltage values and the second bit width drive voltage values and obtain the drive voltage conversion relationship table according to the light emission brightness values matching the brightness values of the first bit width drive voltage values.

11. The display device as claimed in claim 9, wherein the main control chip is configured to: obtain a bit width value of a drive voltage value of the liquid crystal display panel; when the bit width value of the drive voltage value of the liquid crystal display panel is equal to a bit width value of each of the second bit width drive voltage values, determine the second bit width drive voltage values of the target backlight units when the target display frame is displayed according to the drive voltage conversion relationship table between the first bit width drive voltage values and the second bit width drive voltage values based on the brightness values; and when the bit width value of the drive voltage value of the liquid crystal display panel is equal to a bit width value of each of the first bit width drive voltage values, determine the second bit width drive voltage values of the target backlight units when the target display frame is displayed according to a bit width data conversion table.

12. The display device as claimed in claim 9, wherein the main control chip is configured to:

obtain the brightness datum of each of the pixels in the target display units when the target display frame is displayed;

determine noise data of an image to be displayed of the target display units when the target display frame is displayed according to the brightness datum of each of the pixels in the target display units; and determine the target brightness values of the target backlight units corresponding to the target display units when the target display frame is displayed according to the brightness datum of each of the pixels in the target display units and the noise data of the image to be displayed of the target display units.

13. The display device as claimed in claim 12, wherein the main control chip is configured to:

traverse the pixels in the target display units sequentially according to a traverse parameter and obtain a plurality of traverse blocks;

determine a brightness sum value of all of the pixels in each of the traverse blocks according to the brightness datum of each of the pixels in the target display units; and determine the noise data of the image to be displayed of the target display units when the target display frame is displayed according to a method of determining the noise data corresponding to the target display units and the brightness sum value of all of the pixels in each of the traverse blocks.

14. The display device as claimed in claim 13, wherein the main control chip is configured to:

set the noise data of the image to be displayed of the target display units as a first numerical value when each of the brightness sum values of all of the pixels of all of the traverse blocks is less than a first threshold value;

set the noise data of the image to be displayed of the target display units as a second numerical value when the brightness sum value of all of the pixels of any one of the traverse blocks is greater than a second threshold value; and set the noise data of the image to be displayed of the target display units as a third numerical value when each of the brightness sum values of all of the pixels of all of the traverse blocks is less than the second threshold value and the brightness sum value of all of the pixels of any one of the traverse blocks is greater than the first threshold value.

15. The display device as claimed in claim 14, wherein the main control chip is configured to:

select the traverse blocks each of which has the brightness sum value of all of the pixels less than the second threshold value and greater than the first threshold value out from all of the traverse blocks as subject traverse blocks; and determine the third numerical value according to a total amount of the subject traverse blocks.

16. The display device as claimed in claim 9, wherein the main control chip is configured to:

read compression demura data in a compressed status stored in a storage device, and load the compression demura data into a memory, wherein the compression demura data comprise compressed demura data corresponding to the display units and identifiers configured to identify addresses of the compressed demura data respectively;

call at least two decoding modules; based on the identifiers, by the at least two decoding modules, decode one of the compression demura data in the memory corresponding to a current display position, and obtain a decoded actual demura datum of each of the display units of the current display position; and determine the drive voltage value of each of the pixels in the target display units when the target display frame is displayed based on the brightness datum of each of the pixels and the actual demura datum, and transmit the drive voltage value to the second driver chip.

* * * * *